US007013607B1

(12) United States Patent
South

(10) Patent No.: US 7,013,607 B1
(45) Date of Patent: Mar. 21, 2006

(54) MONOLITHIC DOME STRUCTURE HAVING UNITARY CONTOURED LATERALLY MOVEABLE ACCESS DOOR

(76) Inventor: David B. South, 177 Dome Park Pl., Italy, TX (US) 76651

( * ) Notice: Subject to any disclaimer, the term of this patent is extended or adjusted under 35 U.S.C. 154(b) by 0 days.

(21) Appl. No.: 10/660,827

(22) Filed: Sep. 12, 2003

(51) Int. Cl.
*E04B 7/08* (2006.01)

(52) U.S. Cl. ..... 52/81.2; 52/65; 52/80.1; 52/82; 52/236.2; 52/245; 52/309.12; 264/32; 264/34; 264/131; 264/510; 264/512

(58) Field of Classification Search ..... 52/65, 52/236.2, 80.1, 81.2, 82, 309.12; 265/32, 265/34, 131, 510, 512
See application file for complete search history.

(56) References Cited

U.S. PATENT DOCUMENTS 1,861,069 A * 5/1932 Smith ..... 52/65
2,964,144 A * 12/1960 Wheeler ..... 52/65
3,670,464 A 6/1972 Cutter
3,736,707 A * 6/1973 Neufeld ..... 52/65
3,815,298 A * 6/1974 Pope ..... 52/65
4,155,967 A 5/1979 South et al.
4,324,074 A 4/1982 South et al.
4,646,659 A 3/1987 Roy
4,694,620 A 9/1987 Pope
4,697,392 A 10/1987 Silzle
4,850,160 A * 7/1989 Mullin, Jr. ..... 52/82
4,979,869 A * 12/1990 Mullin, Jr. ..... 414/807
5,647,074 A 7/1997 White, Jr. et al.
5,918,438 A 7/1999 South

* cited by examiner

*Primary Examiner*—Carl D. Friedman
*Assistant Examiner*—Yvonne M. Horton
(74) *Attorney, Agent, or Firm*—Welsh & Katz, Ltd.

(57) ABSTRACT

A monolithic dome shaped building of a size suitable to receive at least one relatively large vehicle, such as an airplane, is formed with a generally rectangular shaped access opening of sufficient size to enable passage of an airplane or other large vehicle into and out of the building. A three-dimensional unitary door is supported at an upper marginal edge on a guide track for lateral movement of the door between a first position closing the access opening and a second open position enabling passage through the access opening. The door includes a rigid frame structure having spaced upstanding frame members having outer convex surfaces similar to the convex contour of the dome wall adjacent the access opening. An outer metallic sheet or skin may be secured to the outer convex surfaces of the upstanding frame members to create a lightweight door, or a mesh reinforced built-up layer of cementitious material may be formed on the door frame to create a high strength door construction similar in cross-section to the cross-sectional makeup of the dome shaped building.

19 Claims, 3 Drawing Sheets

MONOLITHIC DOME STRUCTURE HAVING UNITARY CONTOURED LATERALLY MOVEABLE ACCESS DOOR

FIELD OF THE INVENTION

The present invention relates generally to dome shaped building structures, and more particularly to a monolithic dome shaped building particularly adapted for housing at least one vehicle, such as an airplane, and having an access opening sized to enable entry of the vehicle, and a laterally moveable unitary door operative to close the access opening and having a three-dimensional external contour similar to the contour of the dome wall adjacent the access opening.

BACKGROUND OF THE INVENTION

Innovations in building construction techniques have resulted in what have generally become known as monolithic dome structures, such as disclosed in U.S. Pat. Nos. 4,155,967 and 5,918,438 that are incorporated herein by reference. Such monolithic dome structures exhibit high strength and heat efficiency and are generally formed by securing the peripheral marginal edge of an inflatable form to a footing, inflating the form so as to create a dome shape, applying one or more layers of foam to the inner surface of the form, preferably securing hanger members to the foam layer to which a metallic reinforcing mesh is attached, and applying one or more layers of a cementitious material to the inner exposed surface of the foam so as to embed the mesh and form a built-up high strength dome structure after curing of the applied layers. A sprayable cementitious material suitable for progressive layer buildup is commercially available as "Gunite" and "Shotcrete" that are mixtures of graded sand and cement. The inflatable form may be removed if desired and a coating applied to the outer surface of the thus formed dome structure to protect it from possible moisture and ultraviolet degradation.

The aforedescribed dome construction techniques lend themselves to alternative dome shapes and sizes. This is particularly significant when utilizing monolithic dome structures for airplane hangars that inherently are of substantial size. The innate strength of monolithic dome hangars provides protection for the aircraft from high winds, tornados, hurricanes, earthquakes, fire, burglary, sabotage and other natural and manmade hazards. Such structures also exhibit highly efficient heat energy and cooling characteristics, thus contributing significantly to environment conservation.

In forming monolithic dome building structures, at least one access opening to the interior of the dome structure is generally formed at ground level so as to accommodate a doorway structure that usually includes one or a pair of vertically hinged access doors. While suitable for conventional size access openings in dome structures, vertically hinged access doors, or alternatively roll-up type doors, are generally limited in size and thereby limit the size of the corresponding access opening formed in the wall of the dome structure.

Airplane hangars have traditionally employed aircraft entry doors that are necessarily relatively large, but are made light enough to enable relatively easy opening and closing. Examples of airplane hangar doors include single-fold lifting doors, bi-fold lifting doors, and sliding doors that stack to a side of the aircraft entry opening. Such hangar doors are susceptible to damage from high winds so as inhibit proper operation of the doors in addition to exposing aircraft within the hangar to possible wind damage. There thus exists a need for a high strength door for monolithic dome style hangars that can withstand the rigors of high winds and the like without compromising ease of opening and closing relative to an aircraft access opening.

BRIEF SUMMARY OF THE INVENTION

In carrying out the present invention, a monolithic dome building structure is provided of a size suitable to receive at least one relatively large vehicle, such as an airplane or large off-the-road vehicle. When constructed to house an airplane, the dome structure is termed a hangar and is formed with a relative large access opening at ground level of sufficient width and height to enable passage of an airplane into and out of the hangar. In a preferred embodiment, the access opening is substantially rectangular or trapezoidal, as viewed in elevation from externally of the hangar, with an upper margin of the opening preferably being disposed parallel to the floor of the hangar. A unitary three-dimensional closure door is supported at upper and lower horizontal marginal edges for lateral movement between a first position closing the access opening and a second position offset from the access opening to enable ingress and egress to and from the hangar interior. A horizontal guide track is preferably secured internally of the dome shaped hangar adjacent the upper margin of the access opening and receives and supports guide rollers attached to the upper margin of the door for enabling lateral opening and closing movement of the door relative to the access opening. Support rollers are secured to the door adjacent its lower marginal edge for rolling engagement with the floor surface of the hanger and support a substantial portion of the weight of the door. At least one of the bottom support rollers may be rotatably driven or powered to facilitate remote controlled lateral movement of the door.

The Unitary hangar door preferably has a suitable strength frame structure that includes spaced upstanding metallic frame members having their opposite ends secured to parallel horizontal upper and lower metallic frame members. The upper and lower frame members are arcuate in plan view and each has a radius of curvature similar to the curvature of the dome considered in a horizontal plane taken at the corresponding elevation of the access opening. The upstanding frame members lie in spaced vertical planes and are curved or contoured, as considered in side edge profile, substantially similar to the convex exterior contour or profile of the dome wall adjacent the access opening. An outer metallic sheet or skin may be secured to the outer convex edges of the upstanding frame members to create a three-dimensional contoured lightweight door. Alternatively, a similar outer sheet or skin can be secured to the outer convex edges of the upstanding frame members followed by applying a foam layer to the inner surface of the outer skin. A reinforcing mesh of welded wire fabric or reinforcing steel laid in a mesh pattern is then preferably attached to the foam layer between the upstanding frame members after which a cementitious material, such as Gunite or Shotcrete, may be sprayed onto the foam layer so as to embed the mesh in built-up layers and form a unitary door construction similar to the cross-sectional makeup of the dome shaped hangar. A protective coating may be applied to the outer sheet or skin as protection from moisture and ultraviolet degradation. In this manner, a high-strength unitary three-dimensional access door of upwards of twelve inches in transverse thickness is provided that is capable of withstanding high winds and the like and can be readily moved laterally along the upper support track to a position inside and adjacent the hangar wall with minimal reduction in interior space within the hangar. If desired, insulating weather seals may be secured to the door adjacent laterally opposite and upper marginal edges thereof or on the inner surface of the hangar wall adjacent the access opening for weather sealing the door when in its closed position.

Accordingly, one of the primary objects of the present invention is to provide a dome shaped building structure having a unitary access door laterally moveable between open and closed positions relative to an access opening, and wherein the door has a three-dimensional contour similar to the contour of the dome shaped building wall adjacent the access opening.

A more particular object of the present invention is to provide a dome shaped building structure of sufficient size and strength to serve as an airplane hangar and having a generally rectangular access opening of sufficient size to enable passage of an airplane into and out of the hangar, and including a unitary three-dimensional an access door laterally moveable on a horizontal track adjacent the access opening between open and closed positions relative to the access opening.

A feature of the unitary three-dimensional hangar access door in accordance with the present invention lies in supporting its lower marginal edge on rollers that engage a floor or ground surface of the hangar and both facilitate lateral opening and closing movement of the door relative to the access opening and support a substantial portion of the weight of the door for ease of movement.

Another feature of the hangar access door in accordance with the invention lies in constructing the door with a metallic frame to which a metallic mesh may be affixed after which a built-up layer of cementitious material is applied to embed the frame and mesh, thereby providing a rigid, unitary high strength security door for the hangar that has a three-dimension external contour or profile similar to the contour of the adjacent dome structure with which it is used.

Further objects, features and advantages of the monolithic dome building structure and associated unitary three-dimensional access door in accordance with the present invention will become apparent from the following detailed description taken in conjunction with the accompanying drawings wherein like reference numbers designate like elements throughout the several views.

Figure 1:
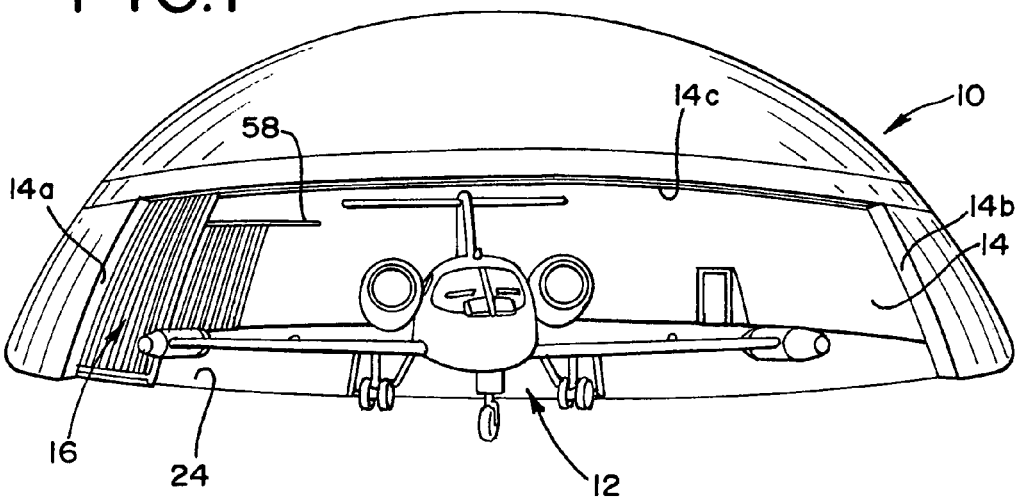
FIG. 1 is an elevational view of a monolithic dome hangar structure having a laterally moveable unitary three-dimensional access door operable to close an access opening that is sized to enable entry of a large vehicle, such as an airplane, into the hangar structure when the door is moved laterally to a retracted open position as shown.

While the present invention is susceptible of various modifications and alternative forms, specific embodiments thereof are shown by way of example in the drawings and will herein be described in detail. It should be understood, however, that the drawings and detailed description thereof are not intended to limit the invention to the particular form disclosed, but on the contrary, the invention is intended to cover all modifications, equivalents and alternatives falling within the spirit and scope of the invention.

DETAILED DESCRIPTION OF THE INVENTION

Figure 2:
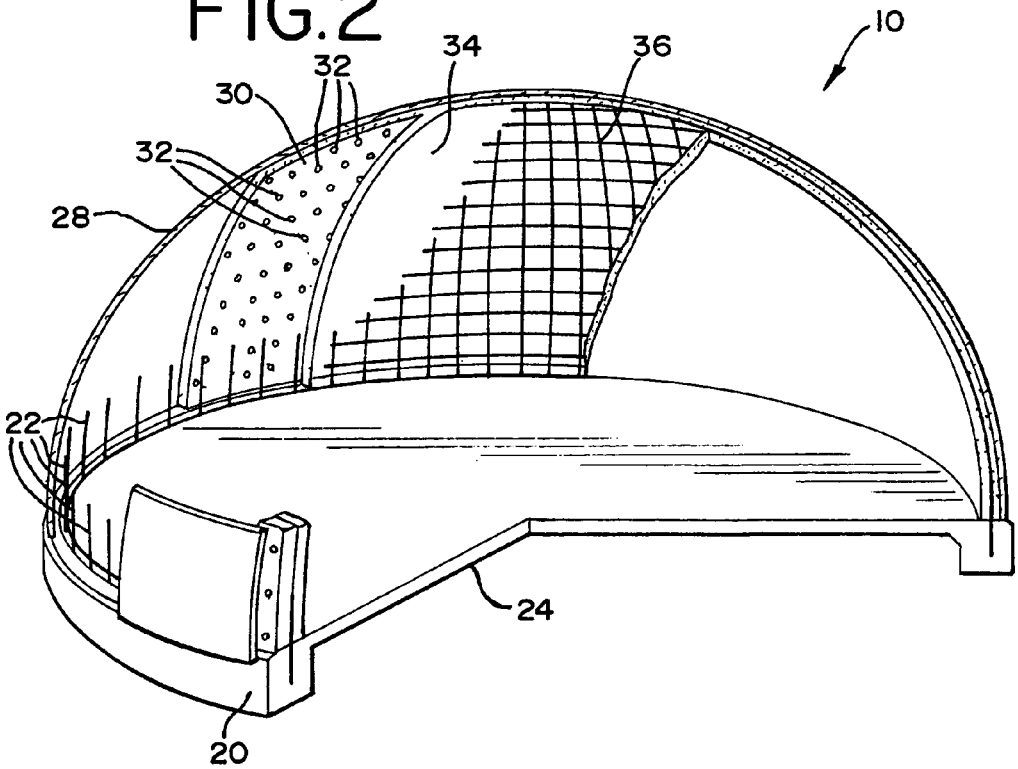
FIG. 2 is a schematic view illustrating a preferred construction of the monolithic dome structure illustrated in FIG. 1.

Referring now to the drawings and in particular to FIGS. 1 and 2, a monolithic dome building structure in the form of a hangar constructed in accordance with the present invention is indicated generally at 10. In the illustrated embodiment, the dome building structure 10 is of sufficient size to receive a relatively large vehicle, such as an airplane indicated at 12 in FIG. 1. Briefly, the dome shaped building or hangar has an access opening 14 of a size sufficient to enable the airplane 12, or other large vehicle, to enter into and exit from an interior chamber or cavity defined within the dome shaped hangar. A unitary three-dimensional door, indicated generally at 16, cooperates with the dome shaped building so as to enable lateral movement of the door between a first position closing the access opening 14 and a second position enabling full access through the opening 14 as will be described in greater detail.

Turning now to a more detailed description of the monolithic dome building 10 and associated door 16, FIG. 2 is a schematic representation of the construction of the dome shaped building 10. The particular construction of the dome shaped building 10 is exemplified in U.S. Pat. No. 4,155,967 that is incorporated herein by reference. For larger dome buildings, the monolithic dome building 10 may be formed in accordance with the monolithic dome building disclosed in U.S. Pat. No. 5,918,438 which is also incorporated herein by reference.

As illustrated schematically in FIG. 2, the dome shaped building 10 in the illustrated embodiment has a circular base defined by an annular concrete footing or foundation 20, alternatively termed a ring beam footing, having a diameter suitable to establish a particular size monolithic dome building desired. The footing 20 is sized to comport with the weight bearing capacity of the underlying soil. A plurality of selected length steel reinforcing bars or rods 22 are secured in upstanding relation within the footing 20 so as to be spaced circumferentially about the footing and extend upwardly therefrom. The rods 22 will subsequently project upwardly within a built-up concrete layer to assist in affixing an upper building structure to the foundation footing 20. As disclosed in the aforementioned U.S. Pat. No. 4,155,967, the monolithic dome building 10 may take alternate configurations such as a barrel shape, an elliptical shape, or a rectangular shape, each configuration being capable of various sizes. For example, the illustrated circular foundation or footing 20 may have a base diameter as large as 750 feet, while a barrel shape configuration may have width of 600 feet and substantially unlimited length. A floor structure 24 may be formed of concrete or other suitable material to provide the necessary support strength for any vehicle or other device to be stored within the building 10.

Following forming of the footing 20, the peripheral marginal edge of a lightweight gas and liquid impermeable inflatable sheet form 28 is releasably secured to the footing 20, preferably after the major equipment that will be used in the construction of the monolithic dome building has been placed within the annular footing 20 before the form 28 is secured to the footing. The inflatable form 28, which may alternatively be termed an airform, may be made of a suitable cross laminate plastic, a reinforced plastic coated fabric such as a polyvinylchloride impregnated polyester, or other suitable material. The peripheral edge of the form 28 is releasably secured to the outer periphery of the footing 20 by suitable means such as a sheathed clamping cable (not shown) pulled tight to engage the peripheral marginal edge of the inflatable form within a keyway formed in the footing. Alternatively, the periphery edge of the form can be secured to the footing 20 by suitably spaced screws adapted to be screwed into the concrete footing through appropriate openings or gores formed in the form.

After securing the peripheral edge of the form 28 to the footing 20, the form is inflated by a suitable blower assembly sized to provide the desired air pressure within the form 14 to effect inflation thereof. After inflating the form 28, a layer of foam 30 is applied against the inner surface of the inflated form and which, after curing, provides a surface against which a plurality of hanger members 32 are preferably attached, followed by a second layer of foam that after curing assists in securing the hanger members 32 to the first player of foam 30. The hanger members 32 are adapted to extend inwardly from the cured second layer of foam 34 and enable attachment of reinforcing means in the form of a suitable steel wire mesh 36. The reinforcing mesh 36 is of known design, such as a welded wire fabric or reinforcing steel laid in a mesh pattern, and is preferably applied so as to cover substantially the full interior surface of the thus far constructed dome building except for intended openings for any personnel access doors, the access opening 14 and any windows anticipated in the completed building structure. As disclosed in the aforementioned '967 patent, simultaneously with securing the reinforcing mesh 36 to the hanger members 32, strap type hangers (not shown) may be secured to the reinforcing mesh for later supporting or mounting of lights, wiring fixtures and the like.

Prior to securing the reinforcing mesh 36 to the hanger members 32, a coating of cementitious material, such as commercially available as "Gunite" and "Shotcrete", may be applied against the inner surface of the cured second foam layer 34 to a depth of approximately ½" SO as to form a preliminary coating of concrete after which the reinforcing mesh is positioned in slightly spaced relation from the initial layer of concrete. Thereafter, a second layer of cementitious material is applied to the inner exposed surface of the first layer and so forth until the desired thickness of cementitious layers is obtained to establish a dense concrete layer having a cured compressive strength of approximately at least 4,000 p.s.i. or greater. If desired, the cementitious material may contain metallic reinforcing fibers which facilitate spraying and contribute to increased strength. It will be appreciated that as the cementitious material 38 is built-up by successive layers, the air pressure within the dome structure is increased to compensate for the added weight of the cementitious layers and maintain a substantially constant uplift force on the form.

After completing the monolithic dome building structure as thus far described, the inflatable form 28 may be removed from the outer foam layer 30 and a protective coating, such as asphalt or a suitable paint, can be applied over the outer exposed urethane foam layer to protect it from moisture and ultraviolet degration caused by exposure to the sun. Alternatively, the inflatable form may be retained on the completed dome structure and, if desired, coated to provide additional protection to the building structure.

During forming of the thus far described monolithic dome structure or building 10, suitable structural framing forms may be supported at desired locations to create openings for windows, personnel access doors and the relatively large aircraft access opening 14 so that the aforedescribed foam and cementitious layers abut the outer periphery of the forms but do not cover the intended window openings or door passageways. In this manner, after curing of the cementitious material and removal of the inflatable forms 28, windows and personnel access doors can be mounted on the dome structure.

As aforedescribed, the access opening 14 is of sufficient size to enable entry of an airplane, or similarly configured and/or sized vehicle, into and exit from the interior of the dome structure. In the illustrated embodiment, the access opening 14 has a generally rectangular or trapezoidal configuration, as viewed in elevation as in FIG. 1. The access opening 14 is thus defined by laterally opposite marginal edges 14*a* and 14*b* each of which lies in a vertical plane containing the vertical center axis of the dome. The access opening 14 is further defined by an upper horizontal marginal edge 14*c* so that when viewed in elevation as in FIG. 1, the access opening 14 appears to have a generally rectangular or trapezoidal configuration.

Figure 4:
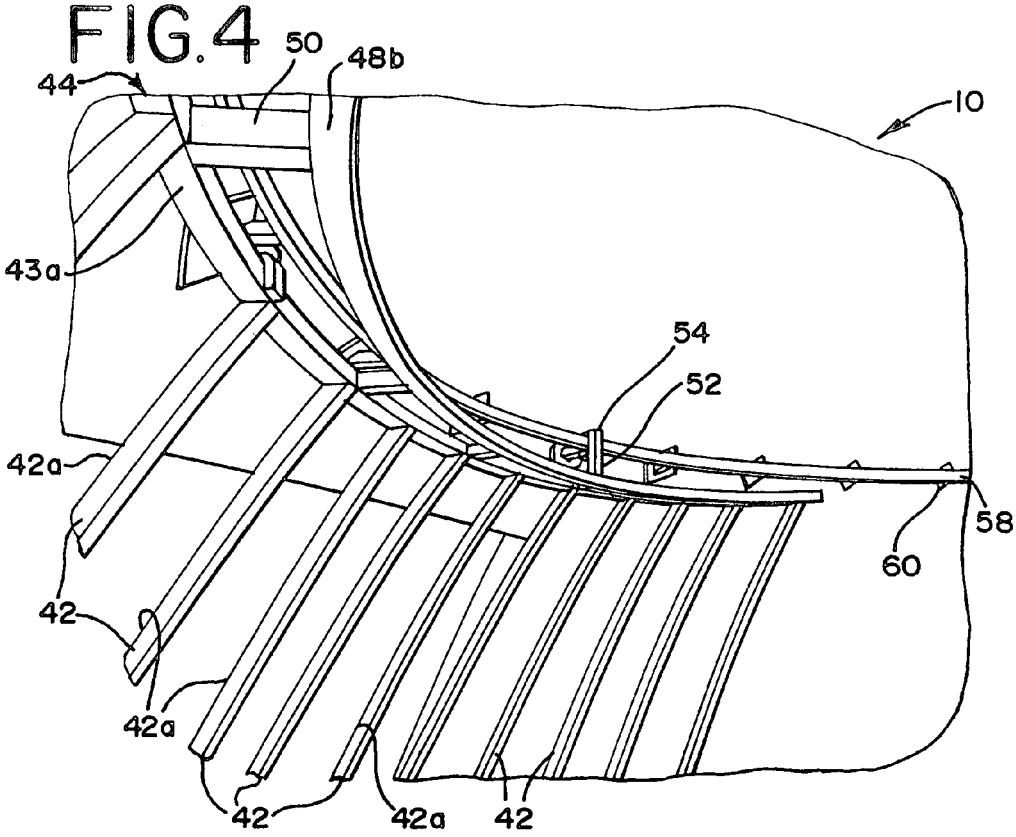
FIG. 4 is a fragmentary view of the access door frame structure and the manner of supporting the upper margin of the door on a horizontal guide track fixed internally of the dome shaped hangar.
Figure 5:
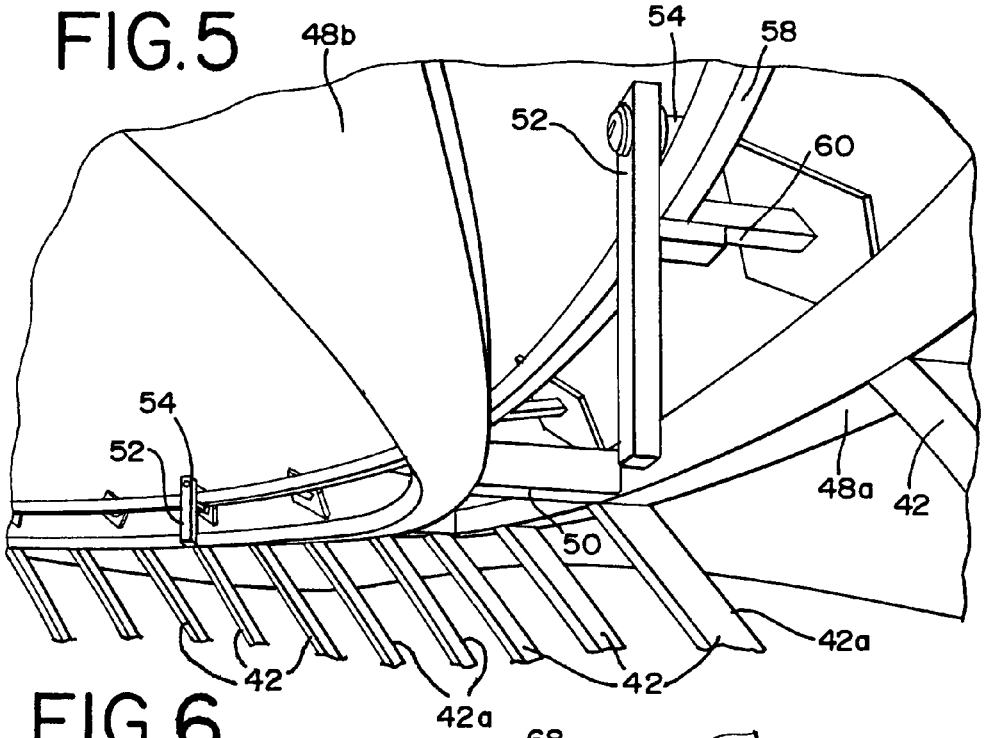
FIG. 5 is a fragmentary view similar to FIG. 4 but illustrating in greater detail the manner of supporting the upper margin of the door on the horizontal guide track.

The unitary three-dimensional door 16 is laterally moveable between a position closing the access opening 14 and an open position enabling passage of a vehicle through the access opening 14. Referring to FIG. 1, taken in conjunction with FIGS. 3–7, the door 16 in its preferred embodiment includes a frame structure including a plurality of identical horizontally spaced upstanding metallic frame members 42 that lie in vertical planes. The frame members 42 may have a generally rectangular solid or tubular transverse cross-section and are formed with an outer convex curvature or vertical front edge profile 42*a* that is substantially similar to the outer profile or contour of the monolithic dome adjacent the opening 14 between ground level and a height substantially the same as the upper horizontal margin 14*c* of the access opening 14. The upper and lower ends of the upstanding frame members 42 are secured, as by welding, respectively, to an upper horizontal metallic frame assembly 44 and a lower horizontal metallic frame assembly 46 so that each of the upstanding frame members 42 lies in a plane transverse to the parallel upper and lower frame assemblies. As illustrated in FIGS. 4 and 5, the upper horizontal frame assembly 44 includes a pair of substantially parallel metallic frame members 48*a* and 48*b* that are connected in co-planar parallel relation by connector frame members 50 so as to form a frame assembly having an arcuate curvature, considered in plan view, corresponding to the curvature of the monolithic dome building considered in a horizontal plane at substantially the upper horizontal margin 14*c* of the access opening 14.

Figure 7:
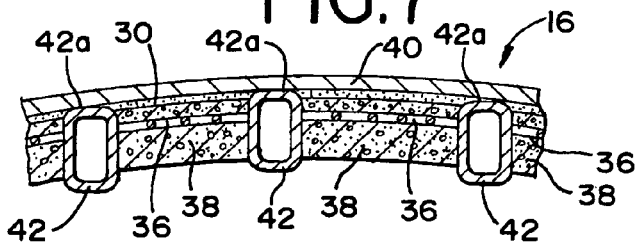
FIG. 7 is a fragmentary transverse sectional view, on an enlarged scale, of the access door as taken generally along line 7—7 of FIG. 3.

Referring to FIG. 7, an outer generally rigid metallic sheet or skin 40 is preferably secured to the outer convex edges

42*a* of the frame members 42, as by spot welding or mechanical fasteners, to create a three-dimensional contoured lightweight door. When a stronger high force resistant door is desired, a similar outer metallic sheet or skin 40 can be secured to the outer convex edges of the upstanding frame members 42 followed by applying a foam layer 30 to the inner surface of the outer sheet either between or also covering the exposed surfaces of the frame members. A reinforcing mesh 36 of welded wire fabric or reinforcing steel laid in a mesh pattern is then preferably attached to the foam layer between the upstanding frame members after which a built-up layer of cementitious material 38, such as Gunite or Shotcrete, is sprayed onto the foam layer so as to embed the mesh 36 in built-up layers and form a unitary door construction similar to the cross-sectional makeup of the dome shaped hangar wal but without the frame members 42. A protective coating may be applied to the outer sheet or skin 40 as protection from moisture and ultraviolet degradation. In this manner, a high-strength unitary three-dimensional access door of upwards of twelve inches in transverse thickness can be provided that is capable of withstanding high winds and the like.

To facilitate lateral movement of the unitary door 16, the upper frame assembly 44 includes a plurality of hanger members 52 each of which is affixed in upstanding relation to the frame member 48*a* and has an upper horizontal support shaft fixed thereto on which a roller 54 is supported. The horizontal axis guide rollers 54 supported on the upper ends of the hanger members 52 overlie and ride on a horizontal guide track 58 that is secured to the inner surface of the monolithic dome building 10 generally adjacent the upper marginal edge 14*c* of the access opening 14. The guide track 58 is supported by a plurality of coplanar horizontal support members 60 each of which is suitably affixed to the inner surface of the dome wall so that the guide track 58 lies in a horizontal plane generally parallel to the inner surface of the adjacent dome wall. The guide track extends from adjacent one end of the access opening 14, such as the end surface 14*b*, to a position spaced from the opposite end 14*a* a distance sufficient to support the access door 16 when in its fully opened position.

Figure 6:
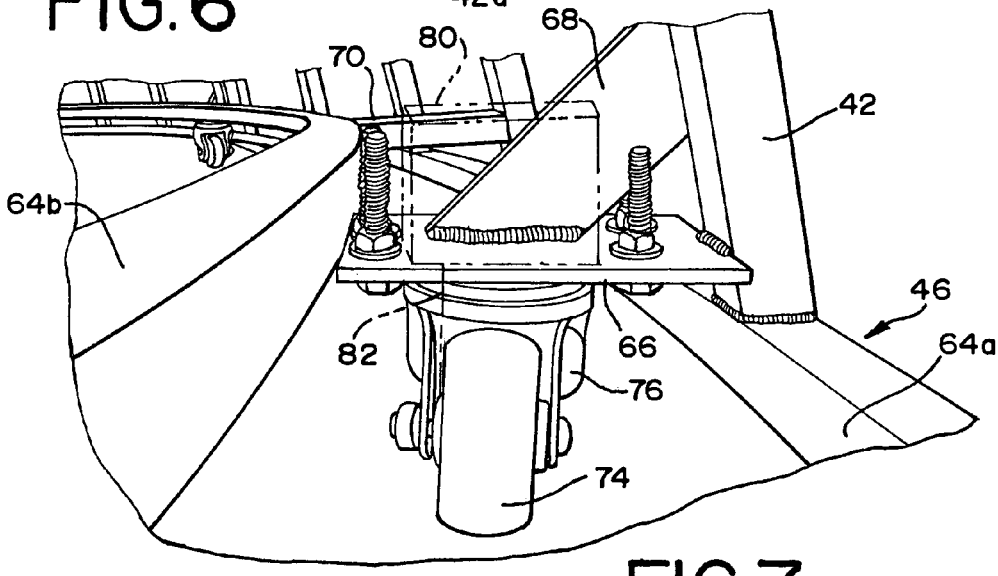
FIG. 6 is a fragmentary view illustrating a representative support roller mounted at the lower margin of the door frame for providing rolling engagement with a floor surface of the dome structure, a power drive for the roller being shown schematically.

The lower margin of the access door 16 is supported by rollers or wheels that engage the floor surface 24 of the monolithic dome building 10 to facilitate lateral movement of the access door and also support a substantial portion of the weight of the access door. Referring particularly to FIG. 6, the lower horizontal frame assembly 46 includes a pair of substantially parallel elongated frame members 64*a* and 64*b* that are interconnected by horizontal support plates 66 each of which is affixed at one end to a corresponding upstanding metallic frame member 42, as by welding, and has its opposite end affixed to the inner frame member 64*b*. Preferably a reinforcing strut 68 is fixed to the top of each of the support plates 66 and to the corresponding upstanding frame member 42. A plurality of horizontal connector members 70 have their opposite ends secured to corresponding ones of the upstanding frame members 42 and the frame member 64*b* intermediate the support plates 66 to further rigidify the frame assembly 46, as illustrated in FIG. 6.

Each of the support plates 66 has a roller type wheel assembly 74 secured to its lower surface that includes a bifurcated wheel support bracket 76 rotatable about a vertical axis through a conventional bearing assembly. In this manner, the lower margin of the access door 16 when fully assembled is supported by the roller wheels 74 which facilitate lateral movement of the door between its open and closed positions relative to the access opening 14 and also support a substantial portion of the weight of the access door.

One or more of the rollers wheels 74 may be powered for driving rotation by conventional drive means, such as a motor driven gear reducer as illustrated schematically in phantom at 80 in FIG. 6. The gear reducer may be connected in driving relation to the associated roller wheel 74 by any suitable means such as a drive chain or belt as depicted by phantom line 82. The roller wheel drive means 80 is preferably electrically powered and connected in a control circuit with one or more other roller wheel drive units to enable remote operation or energizing of the power drives to effect opening and closing of the hangar access door 16 from internally or externally of the associated dome structure or from a remote power control device.

Figure 3:
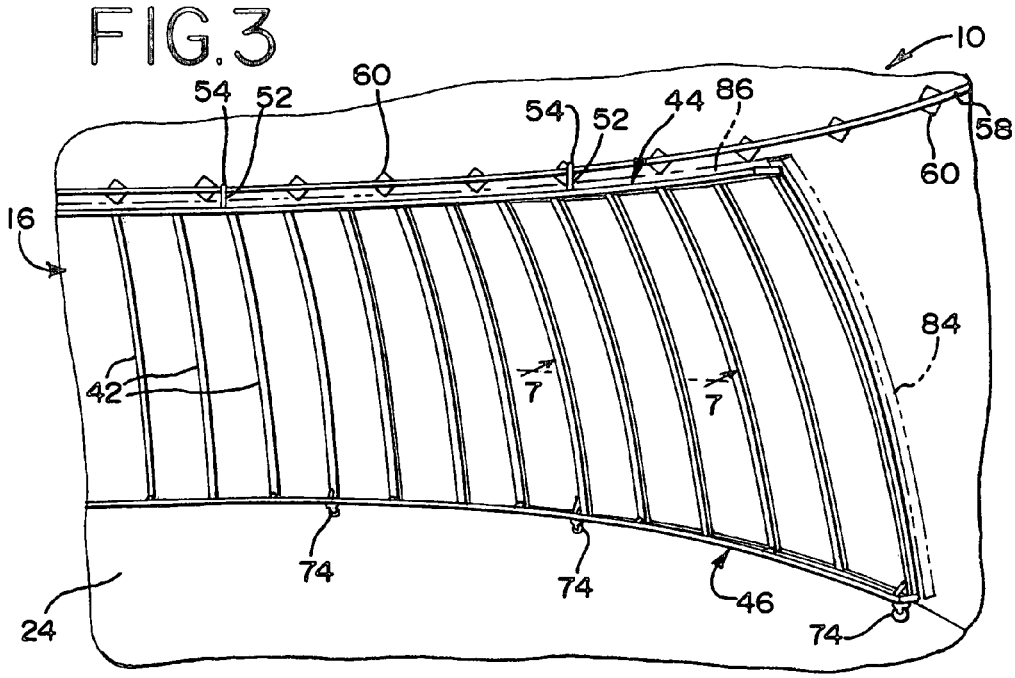
FIG. 3 is a fragmentary view taken internally of the monolithic dome hangar structure and illustrating the laterally moveable three-dimensional contoured access door supported at its upper and lower margins for lateral sliding movement on an upper horizontal guide track and on lower floor engaging support rollers.

Preferably, conventional elongated seals are mounted on the inner surface of the dome building or hangar 10 adjacent the laterally opposed end surfaces 14*a,b* and the horizontal upper edge 14*c* of the access opening 14, as indicated in phantom at 84 and 86 in FIG. 3, for sealing contact with the corresponding margins of the access door 16 when in its closed position. Alternatively, the seals may be formed on the outer laterally opposite and upper marginal edges of the door for sealing cooperation with the either the inner surface of the dome building or for sealing cooperation with juxtaposed seals fixed on the inner wall surface of the building adjacent access opening 14.

It will be understood that the upper and lower door frame assemblies 44 and 46 may take various alternative structural designs between which the upstanding frame members 42 are supported to form a high strength unitary door frame assembly enabling the finished door to have an external convex three-dimensional contour similar to the external contour of the monolithic dome building adjacent the access opening 14.

While a preferred embodiment of the monolithic dome building 10 and associated access door 16 have been illustrated and described for use as an airplane or other large vehicle hangar, the invention finds application with monolithic dome buildings of various sizes, both small and large. Thus, changes and modifications may be made therein without departing from the invention in its broader aspects. Various features of the monolithic dome structure and associated access door 16 are defined in the following claims.

What is claimed is:

1. A monolithic dome building including a generally dome shaped unitary monolithic peripheral wall that includes a mesh reinforced built-up layer of cementitious material defining an outer generally convex surface and an interior chamber and having an access opening enabling entry into and exit from the chamber, and a rigid unitary door operatively associated with the building and adapted for lateral movement between a first position closing said access opening and a second position enabling passage through the access opening, said door having a rigid frame structure supporting an outer metallic sheet or a mesh reinforced built-up layer of cementitious material defining a generally unitary closure wall having a three-dimensional convex external contour substantially similar to the outer convex contour of the dome shaped building adjacent the access opening, said door being supported on the building at an upper margin of the door on a substantially horizontal guide track for lateral movement between said first and second positions, said guide track extending internally of said chamber adjacent a wall of the building so that the door complements the dome shaped peripheral wall when in its first position and is disposed in closely spaced relation to said wall when in its second position.

2. A monolithic building as defined in claim 1 wherein the building includes a floor surface, said door having a lower margin operatively associated with roller wheel means for engaging the floor surface in rolling contact therewith and at least partially supporting the door.

3. A monolithic dome building as defined in claim 1 wherein said interior chamber is defined by an outwardly convexly curved peripheral wall having a substantially uniform transverse thickness, and including a substantially horizontal guide track affixed to an inner surface of said wall adjacent the access opening, said door having means adjacent an upper marginal edge thereof for mutual cooperation with said track to enable lateral sliding movement of the door between said first and second positions.

4. A monolithic dome building as defined in claim 1 wherein said door includes guide rollers adjacent the upper margin thereof for operative association with said guide track so as to facilitate lateral movement of the door along the track.

5. A monolithic dome building as defined in claim 1 wherein said door includes a plurality of upstanding horizontally spaced frame members, said upstanding frame members having outer convex surface profiles similar to a convex profile of the dome building adjacent said access opening, said upstanding frame members having a generally rigid sheet affixed to said outer convex surfaces so as to form a rigid unified door having an outer convex surface.

6. A monolithic dome building as defined in claim 5 including seal means for effecting sealing between an inner surface of the dome building adjacent the access opening and laterally opposite ends of the door and the upper margin of the door when in its first position closing the access opening.

7. A monolithic dome shaped building defining an interior chamber and having an access opening adjacent a floor surface enabling entry into and exit from the chamber, and a rigid unitary door operatively associated with the building and adapted for lateral movement between a first position closing said access opening and a second position enabling passage through the access opening, said door having a lower margin operatively associated with roller wheel means for engaging the floor surface in rolling contact therewith and being supported at an upper margin on a substantially horizontal guide track for lateral movement between said first and second positions, said door having a three-dimensional convex external contour substantially similar to an outer convex contour of the dome shaped building adjacent the access opening, said guide track extending internally of said chamber adjacent a wall of the building so that the door is disposed in closely spaced relation to said wall when in its second position, said door including upper and lower rigid frame assemblies that are arcuate in plan view and each has a radius of curvature similar to a radius of curvature of the dome building taken in substantially the same horizontal planes as said upper and lower frame assemblies.

8. A monolithic dome building as defined in claim 7 wherein said access opening is generally rectangular when considered in front elevation, said door having a similar generally rectangular peripheral configuration.

9. A monolithic dome building as defined in claim 7 wherein said door includes a plurality of upstanding horizontally spaced frame members having opposite ends affixed to said upper and lower frame assemblies, said upstanding frame members having outer convex surface profiles similar to a convex profile of the dome building adjacent said access opening, said upstanding frame members having a generally rigid sheet affixed to said outer convex surfaces so as to form a rigid unified door having an outer convex surface.

10. A monolithic dome shaped hangar having an outer convexly contoured peripheral wall defining an interior chamber sized to receive at least one airplane and having a generally rectangular shaped access opening of sufficient size to enable passage of an airplane into and out of the chamber, and a three-dimensional unitary door having a rigid frame structure including spaced upstanding frame members disposed between parallel upper and lower arcuately curved frame members, said door having a convexly contoured outer surface similar to said contoured peripheral wall, said upstanding frame members having outer convex surfaces that lie in said similar convexly contoured outer surface, said door being supported at an upper margin on a horizontal track for lateral movement of the door between a first position closing the access opening and a second position enabling passage through the access opening.

11. A monolithic dome building as defined in claim 10 wherein said guide track extends internally of said chamber adjacent a wall of the building so that the door is disposed in closely spaced relation to said wall when in its second position.

12. A monolithic dome building as defined in claim 11 wherein said access opening is generally rectangular when considered in front elevation, said door having a similar generally rectangular peripheral configuration.

13. A dome shaped building as defined in claim 10 including a floor surface, said door having a lower margin including roller wheel supports affixed thereto for engaging the floor surface in rolling contact therewith.

14. A dome shaped building as defined in claim 10 wherein said convexly contoured external wall of the building has a substantially uniform thickness, said horizontal track being affixed to an inner surface of said wall adjacent the access opening, said door having roller means adjacent its upper margin for mutual cooperation with said track to enable lateral sliding movement of the door between its first and second positions.

15. A dome shaped building as defined in claim 14 wherein said roller means adjacent the upper margin of said door includes rollers operatively associated with said track so as to facilitate lateral rolling movement of the door along the track.

16. A dome shaped building as defined in claim 10 wherein said access opening is generally rectangular when considered in front elevation, said closure comprising a unitary door having a generally rectangular peripheral configuration when considered in front elevation.

17. A dome shaped building as defined in claim 10 wherein said upstanding frame members have a generally rigid sheet affixed to said outer convex surfaces so as to form a rigid unified door having an outer three-dimensional convex surface.

18. A dome shaped building as defined in claim 17 including seal means for effecting sealing between an inner surface of the dome building adjacent the access opening and laterally opposite ends of the door and an upper margin of the door when in its first position closing the access opening.

19. A monolithic dome shaped hangar as defined in claim 10 wherein said upstanding frame members have an outer metallic sheet secured to the outer convex edges thereof so as to create a lightweight door, or have a mesh reinforced built-up layer of cementitious material formed on the rigid frame structure to create a high strength unitary door construction similar in cross-section to the cross-sectional makeup of the dome shaped building.

* * * * *